United States Patent [19]

Owaysi et al.

[11] Patent Number: 4,567,315

[45] Date of Patent: Jan. 28, 1986

[54] PROCESS FOR PURIFICATION OF LIQUID PARAFFINS

[75] Inventors: Fathi A. Owaysi, Safat; Rasheed S. Al-Ameeri, Bayan, both of Kuwait

[73] Assignee: Kuwait Institute for Scientific Research, Safat, Kuwait

[21] Appl. No.: 609,121

[22] Filed: May 11, 1984

[51] Int. Cl.[4] ..... C07C 7/13; C10G 25/03

[52] U.S. Cl. ..... 585/827; 585/831; 208/310 Z

[58] Field of Search ..... 208/310 Z; 585/827, 585/831, 833

[56] References Cited

U.S. PATENT DOCUMENTS

| | | | |
|---|---|---|---|
| 2,950,336 | 8/1960 | Kimberlin et al. | 208/310 Z |
| 2,978,407 | 4/1961 | Tuttle et al. | 585/827 |
| 3,078,643 | 2/1963 | Milton | 585/827 |
| 3,133,126 | 5/1964 | Fleck et al. | 208/310 Z |
| 3,205,166 | 9/1965 | Ludlow et al. | 208/310 Z |
| 3,228,995 | 1/1966 | Epperly et al. | 208/310 Z |
| 3,278,422 | 10/1966 | Epperly et al. | 208/310 Z |
| 3,306,847 | 2/1967 | Mueller | 208/310 Z |
| 3,372,108 | 3/1968 | Epperly et al. | 208/310 Z |
| 3,686,342 | 8/1972 | Neuzil | 208/310 Z |

FOREIGN PATENT DOCUMENTS

| | | | |
|---|---|---|---|
| 0711367 | 6/1965 | Canada | 208/310 Z |

*Primary Examiner*—D. E. Gantz
*Assistant Examiner*—Anthony McFarlane
*Attorney, Agent, or Firm*—Willian Brinks Olds Hofer Gilson & Lione

[57] ABSTRACT

Aromatic hydrocarbon impurities are removed from a liquid paraffin containing the same by contacting the liquid paraffin in the liquid phase at relatively low temperatures with an X-type zeolite molecular sieve material. The contacting is performed without recycle and purified liquid paraffin containing less than about 0.01% by weight aromatics is obtained.

20 Claims, 1 Drawing Figure

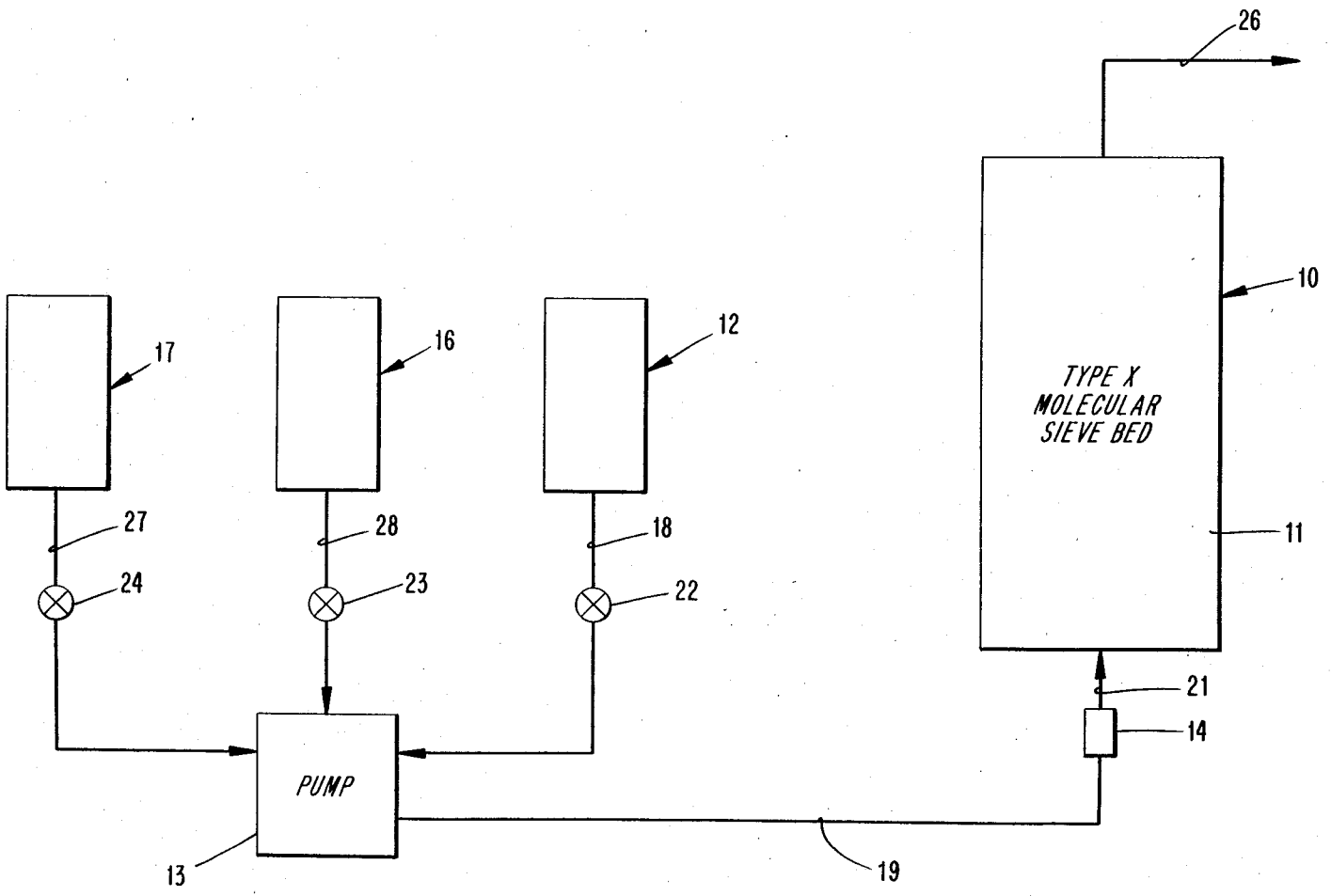
26
10
11
TYPE X
MOLECULAR
SIEVE BED
21
14
19
12
18
22
16
28
23
PUMP
13
17
27
24

PROCESS FOR PURIFICATION OF LIQUID PARAFFINS

FIELD OF THE INVENTION

The invention relates to the purification of liquid paraffins and, more particularly, to the removal of aromatic hydrocarbons from liquid paraffins. Even more particularly, this invention relates to the use of X-type zeolite molecular sieves to remove selectively aromatic hydrocarbons from liquid paraffins, particularly food-grade and pharmaceutical-grade liquid paraffins having from about 8 to about 24 carbon atoms, such that the purified liquid paraffins contain levels of aromatic hydrocarbons at least as low as about 0.01% by weight. The purification process of the present invention is carried out in the liquid phase and at a relatively low temperature, for example, from about 70° to about 90° C.

BACKGROUND OF THE INVENTION

The concept of using various adsorbents, including various natural and synthetic zeolite molecular sieve materials, in processes for effecting physical separations of various mixtures has been known and used both experimentally and commercially for quite some time. For example, S. A. Coviser, (The Oil and Gas Journal, Dec. 6, 1965, pp. 130–32) discussed the adsorption capabilities of silica gel, copper-impregnated activated carbon, type 5A molecular sieves and type 13X molecular sieves with respect to the removal of mercaptan sulfur from natural gas in the vapor phase.

In 1967, L. F. Fominykh, et al., (Khimiya i Tekhnologiya Topliv i Masel, No. 4, pp. 8–10, April 1967) discussed the use of X-type zeolites for the adsorptive separation of benzene from an artificially prepared binary mixture of benzene and n-heptane containing about 12.2% by weight benzene. The separation, which was performed either in vapor phase or liquid phase under dynamic conditions, was said to have reduced the level of benzene in the binary mixture down to about 0.24% by weight.

Another disclosure which relates to the separation of a single aromatic material from a single paraffinic material is contained in Milton, U.S. Pat. No. 3,078,643. In accordance with this Milton patent, toluene can be separated from a vapor mixture of, for example, toluene and n-hexane by contacting the vapor mixture with a bed of zeolite X-type adsorbent material, the pores of which are sufficiently large to adsorb toluene and n-hexane, and thereafter discharging a toluene-depleted vapor stream from the zeolite bed. As indicated in this patent, the level of toluene in the vapor mixture can be reduced to a level of about 3% by weight.

In connection with processes of the type disclosed in the above Fominykh, et al., article and Milton patent, it is noted that the separation of binary systems of n-paraffin-aromatic mixtures has been investigated by researchers for many years. The primary objective of such research generally is either to provide a process of separation for a specific industrial application (as in the case of Milton) or to provide binary data for various systems in an attempt to arrive at a model for the possible prediction of anticipated results for multicomponent adsorption processes. As will be seen from the discussion hereinbelow, the multicomponent separations which are accomplished by the present invention are much more complicated and general in nature than the simple and specific binary mixture separations disclosed, for example, in Milton and Fominykh, et al.

In addition to dealing with simple binary systems, there are a number of prior disclosures relevant to multicomponent separations of aromatics or nonaromatics from saturated hydrocarbons and/or olefins. In many cases, these prior disclosures relate to separation processes which are similar in some respects to the present process, but which, in other important respects, are greatly different therefrom. For example, Epperly, et al., U.S. Pat. No. 3,228,995 relates to a process for purifying $C_{10}$ to $C_{25}$ hydrocarbons containing at least one impurity selected from aromatics, sulfur, and color bodies, wherein the impure hydrocarbons are contacted with a type X zeolite. However, unlike the present process, the process described in this Epperly, et al. patent requires that at least a portion of the absorbed impurities be desorbed with a gaseous displacing agent, such as gaseous $SO_2$, $NH_3$, $CO_2$, $C_1$–$C_5$ alcohols, methyl chloride, or the like or, preferably, a gaseous amine having the formula

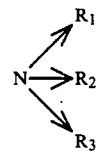

wherein $R_1$, $R_2$ and $R_3$ are hydrogen or a $C_1$–$C_5$ alkyl radical; that the desorbed portion be recycled over the zeolite bed; that the remaining portion of the adsorbed components be desorbed with a gaseous displacing agent; and that the desorbing and recycling be continued for as many as 450 cycles or more until the desired degree of impurity removal has been attained. Moreover, the process described in this Epperly, et al. patent preferably is carried out in the vapor phase and at temperatures on the order of from about 400° to about 800° F.

Another Epperly, et al. patent, i.e., U.S. Pat. No. 3,063,934, relates to the removal of aromatics, olefins and sulfur from a naphtha feed which is to be used for isomerization and paraffin alkylation. In accordance with this patent, a $C_5/C_6$ naphtha feed is contacted with a type X molecular sieve at a temperature of from about 70° to 500° F., and preferably from about 200° to 350° F., to adsorb aromatics, olefins and sulfur therefrom. The aromatics are desorbed from the molecular sieve material during a heat-purge phase wherein the sieve material is contacted with isomerate vapors from an isomerization reactor, which vapors have been heated to about 650° F.

Still other disclosures which relate to the use of molecular sieve materials in separation processes and which are of background interest with respect to the present invention include Milton, U.S. Pat. No. 2,882,244; Tuttle, et al., U.S. Pat. No. 2,978,407; Fleck, et al., U.S. Pat. No. 3,182,017; Ludlow, et al., U.S. Pat. No. 3,205,166; Peck, et al., U.S. Pat. No. 3,265,750; Epperly, et al., U.S. Pat. No. 3,468,791; Shively, et al., U.S. Pat. No. 3,658,696; Epperly, et al., U.S. Pat. No. 3,558,732; Neuzil, U.S. Pat. No. 3,558,730; Eberly, Jr., et al., U.S. Pat. No. 3,485,748; Francis, U.S. Pat. No. 3,726,792; French Pat. No. 1,382,149 (isolation of aromatic hydrocarbons from naphtha and kerosene cuts by using type X molecular sieves); E. L. Clark, (Oil and Gas Journal, No. 46, pp. 178–84, Nov. 12, 1962); A. Z. Dorogochinskii, (Khimya i Tekhnologiya Topliv i Masel, No. 8, pp. 4–6, August 1973); L. C. Waterman, (Chem. Eng. Progr., Vol. 61, No. 10, pp. 51–57, Oct. 1965); and A. G. Martynenko, Khimya i Tekhnologiya Topliv i Masel, No. 8, pp. 11–12, August 1969).

SUMMARY OF THE INVENTION

It is an object of the present invention to provide an improved process for purifying liquid paraffins which are contaminated with aromatic impurities.

It is another object of the invention to provide a liquid phase process for removing aromatics from liquid paraffin by contacting the liquid paraffin with a type X molecular sieve material at temperatures below about 120° C.

It is yet another object of the invention to provide a process for reducing the aromatic content of a liquid paraffin, which process is carried out in the liquid phase at a relatively low temperature and is capable of reducing the aromatic content to a level below about 0.01% by weight.

Still another object is to provide a purified liquid paraffin having an aromatic content below about 0.01% by weight, which purified liquid paraffin is useful for pharmaceutical and single cell protein production.

Another object of the invention is to provide a liquid phase, relatively low temperature adsorption process for reducing the aromatic content of a liquid paraffin to a level of less than about 0.01% by weight using a single adsorbent.

Another object of the invention is to provide a liquid phase, relatively low temperature adsorption process for reducing the aromatic content of a liquid paraffin to a level of less than about 0.01% by weight in a single pass of the liquid paraffin through a bed of adsorbent.

Still another object is to reduce the content of aromatic hydrocarbons contained in a liquid paraffin isolated from a diesel cut by contacting the liquid paraffin in the liquid phase at a temperature below about 120° C. with a type X zeolite molecular sieve material.

Yet another object is to provide a liquid phase adsorption process wherein the loaded adsorbent is desorbed with an agent in the liquid phase.

These and other objects and advantages of the present invention are accomplished by passing a feed of liquid paraffin containing an undesirably-high content of aromatic hydrocarbons through a bed of type X zeolite molecular sieve material. The type X molecular sieve material selectively adsorbs the aromatic hydrocarbons such that with a single pass of the liquid paraffin through the molecular sieve bed, the concentration of aromatic hydrocarbons in the treated paraffin is reduced to less than about 0.01% by weight. The adsorption process is carried out in the liquid phase and at a relatively low temperature, i.e., lower than about 120° C., and usually at a temperature in the range of from about 60° to about 100° C. The preferred operating range is from about 70° C. to 90° C.

The present adsorption process is capable of reducing the aromatic hydrocarbons in the liquid paraffin feed to a concentration of less than about 0.01% by weight in a single pass, i.e., without any recycle of partially-purified paraffin through the molecular sieve bed; and when the bed material becomes excessively loaded with aromatics, it may be cleaned or desorbed by using a liquid phase solvent such as ethanol as a desorption agent.

In one embodiment of the invention, the liquid paraffin to be purified may be isolated from kerosene-diesel cuts and may contain about 3–4% by weight aromatic hydrocarbons.

The purified liquid paraffins of the present invention generally comprise $C_8$–$C_{24}$ paraffins, and preferably $C_9$–$C_{22}$ paraffins, and are suitable for use in pharmaceutical preparations or in the production of single cell proteins.

BRIEF DESCRIPTION OF THE DRAWINGS

The novel features which are characteristic of the present invention are set forth with particularity in the appendant claims, but the various objects and features of the invention will be more clearly and fully understood from the following detailed description taken in conjunction with the accompanying drawing which is a schematic diagram of an apparatus suitable for effecting the process of the invention.

DETAILED DESCRIPTION OF THE INVENTION

Referring now to the drawing, there is shown an adsorption column 10 in which is disposed a bed 11 of pelletized type X zeolite molecular sieve material as the only adsorbent contained therein. As discussed in considerable detail in U.S. Pat. No. 2,882,244 to Milton, which patent is incorporated herein by reference, molecular sieves are synthetic crystalline materials based generally on sodium aluminosilicate. These crystalline materials have a sorption area available on the inside of a large number of uniformly-sized pores of molecular dimensions. With such an arrangement, molecules of a certain size and shape enter the pores and are adsorbed while larger or differently-shaped molecules are excluded.

Type X zeolites consist basically of a three-dimensional framework of $SiO_4$ and $AlO_4$ tetrahedra. The tetrahedra are cross-linked by the sharing of oxygen atoms so that the ratio of oxygen atoms to the total of the aluminum and silicon atoms is equal to two or $O/(Al+Si)=2$. The electrovalence of each tetrahedra containing aluminum is balanced by the inclusion in the crystal of a cation, for example, an alkali or aklaline earth metal ion. This balance may be expressed by the formula:

$$Al_2/(Ca, Sr, Ba, Na_2, K_2)=1$$

One cation may be exchanged for another by ion exchange techniques which are described below. The spaces between the tetrahedra are occupied by water molecules prior to dehydration.

Type X zeolites may be activated by heating to effect the loss of water of hydration. The dehydration results in crystals interlaced with channels of molecular dimensions that offer very high surface areas for the adsorption of foreign molecules.

It will be understood that the refusal characteristics of type X zeolites are quite as important as the adsorptive or positive adsorption characteristics. For instance, if benzene or other aromatic hydrocarbon and $C_8$–$C_{24}$ liquid paraffins are to be separated, as in the present invention, it is as essential that the crystals refuse the liquid paraffins as it is that they adsorb the benzene and other aromatics.

A type X zeolite may be distinguished from other zeolites and silicates on the basis of its X-ray powder diffraction pattern and certain physical characteristics. The composition and density are among the characteristics which have been found to be important in identifying type X zeolites.

The basic formula for all crystalline zeolites where "M" represents a metal and "n" its valence may be represented as follows:

$$M_{2/n}O:Al_2O_3XSiO_2:YH_2O$$

In general, a particular crystalline zeolite will have values for X and Y that fall in a definite range. The value X for a particular zeolite will vary somewhat since the aluminum atoms and the silicon atoms occupy essentially equivalent positions in the lattice. Minor variations in the relative numbers of these atoms does not significantly alter the crystal structure or physical properties of the zeolite. For a type X zeolite, numerous analyses have shown that an average value for X is almost 2.5. The X value falls within the range 2.5–0.5.

The value of Y is not necessarily an invariant for all samples of type X zeolites particularly among the various ion exchanged forms. This is true because various exchangeable ions are of different size, and since there is no major change in the crystal lattice dimensions upon ion exchange, more or less space should be available in the pores of the type X zeolite to accommodate water molecules.

The adsorbents contemplated for use herein include not only the sodium form of type X zeolite as synthesized from a sodium-aluminum-silicate water system with sodium as the exchangeable cation, but also crystalline materials obtained from such a zeolite by partial or complete replacement of the sodium ion with other cations. The sodium cations can be replaced, in part or entirely, by ion exchange with other monovalent, divalent, or trivalent cations. Monovalent ions both smaller than sodium, such as lithium, and larger, such as potassium and ammonium, freely enter the type X zeolite structure and exchange with other cations that might be present. The same is true for divalent ions smaller than sodium, such as magnesium, and larger, such as strontium and barium. Cerium is an example of a trivalent ion that enters the zeolite X structure.

The spatial arrangement of the aluminum, silicon and oxygen atoms which make up the basic crystal lattice of the zeolite remains essentially unchanged by partial or complete substitution of other cations for the sodium ion. The X-ray patterns of the ion exchanged forms of type X zeolite show the same principal lines at essentially the same position, but there are some differences in the relative intensities of the X-ray lines due to the ion exchange.

Among the forms of the type X zeolite that have been obtained by direct synthesis and ion exchange are sodium, lithium, potassium, hydrogen, silver, ammonium, magnesium, calcium, zinc, barium, cerium, and manganese. For convenience, these materials will be referred to by the appropriate chemical symbol for the cation and the letter X. Thus, for example, the sodium form becomes NaX, the calcium form becomes CaX, and the cerium form becomes CeX.

Ion exchange of the sodium form of zeolite X (NaX) or other forms of zeolite X may be accomplished by conventional ion exchange methods. A preferred continuous method is to pack type X zeolite into a series of vertical columns each with suitable supports at the bottom; successively pass through the beds a water solution of a soluble salt of the cation to be introduced into the zeolite; and change the flow from the first bed to the second bed as the zeolite in the first bed becomes ion exchanged to the desired extent.

Although the advantages of the invention can be accomplished by contacting the liquid paraffin with any type of X zeolite, the preferred zeolites contemplated for use in the invention include NaX (type 13X) which exhibits a pore size of about 9 angstrom units, and CaX (type 10X), which exhibits a pore size of about 8 angstrom units. The invention may be practiced using a single type X zeolite in the column 10, such as NaX(-type 13X), or a mixture of type X zeolite in one or more beds. However, in no case can the type X zeolite be used in combination with another adsorbent that is not a type X zeolite, whether in physical admixture in a single bed or in separate beds within the column 10.

Referring again to the drawing, the liquid paraffin to be purified is fed from a holding vessel 12 or other suitable source through the type X molecular sieve bed 11 in the adsorption column 10. The liquid paraffin may be fed directly to the top of the adsorption column for downward passage therethrough under the influence of gravity. In the alternative, as illustrated in the drawing, the liquid paraffin may be forced upwardly through the column 10 by means of a suitable pump 13. The liquid paraffin may be passed through the molecular sieve bed at relatively low temperatures on the order of from about 60° C. to about 120° C. with temperatures in the range of about 70° C. to about 90° C. being preferred. However, in all cases within the scope of this invention, the paraffin is in the liquid phase as it passes through the type X zeolite bed.

Depending upon the source of the liquid paraffin, the paraffin may be passed through the zeolite bed 11 without prior heating or cooling. However, in most cases, the liquid paraffin is passed throuh a heat exchanger 14 immediately prior to being introduced into the molecular sieve bed 11 to adjust the temperature of the liqid paraffin to the desired range, generally about 60°–120° C., and preferably about 70°–90° C.

The ability of operating the present purification process in the liquid phase and at relatively low temperatures provides an important economic advantage over those processes which operate in the vapor phase at temperatures on the order of 300°–800° F. or more. Normally, these vapor phase processes are resorted to only when the liquid phase processes, which have much lower energy requirements, are unable to achieve the desired levels of product purity. Such is not the case with the present liquid phase process which produces products having impurity levels as low as 0.01% by weight and lower while operating at temperatures below about 120° C.

As indicated above, the liquid paraffins contemplated for purification in accordance with this invention generally are those having from about 8 to about 24 carbons and having an undesirably high level of aromatic hydrocarbons contained therein. The paraffins may be straight chain or branched chain materials and may be isolated from petroleum sources, such as diesel cuts. The concentration of aromatic hydrocarbons in the liquid paraffins to be purified may vary over relatively-wide limits depending upon the source of the liquid paraffin, and may be as high as about 20–25% by weight. Normally, however, the concentration of aromatic hydrocarbons in the liquid paraffins to be purified is not more than about 10 to about 15%, and may be as low as about 3–5% by weight or lower. For example, a partially dearomatized liquid paraffin having an aromatic hydrocarbon content of from about 2% to about 4% by weight may be purified in accordance with this invention.

An essential feature of the present invention is that the paraffins to be purified can be done so in a single pass through the type X zeolite bed 11 without having to resort to any recycling. This is an important feature from the standpoint of ease of operation, reduced apparatus requirements and overall process efficiency.

Another essential feature of the present invention resides in the use of a liquid phase desorbent for cleaning the zeolite bed 11 once it has become loaded with aromatic hydrocarbons. Suitable desorbents, which are polar or polarizable materials having an appreciable affinity for the zeolite adsorbent compared with the aromatic hydrocarbon materials desired to be desorbed, include, for example, alcohols, such as methanol, ethanol, propanol, propylene glycol or the like. The desorbent may be stored in a suitable holding vessel 16 from which it can be pumped through the column 10 to desorb the aromatic hydrocarbons from the pores of the type X zeolite molecular sieve material contained in the bed 11.

Once the aromatic hydrocarbons have been desorbed from the pores of the molecular sieve material, the desorbed aromatic hydrocarbons can be washed from the bed by passing a washing solvent, such as n-hexane, n-heptane or iso-octane therethrough. The washing solvent may be stored in a suitable container or vessel 17 and pumped through the sieve bed using the same pump 13 which is used to pump the desorbent and liquid paraffin therethrough. In the alternative, separate pumps (not shown) may be used for the washing solvent, desorbent and liquid paraffin.

The amount of liquid paraffin that can be purified before the adsorbent capacity of the molecular sieve material has been diminished to the point that desorption of the aromatics therefrom is necessary and/or desirable varies greatly depending on the initial level of aromatics in the paraffin feed. However, under normal usage with paraffin feed rates on the order of from about 0.5 to about 20 c.c./min., the molecular sieve bed would have sufficient adsorption capacity (23.4 g of aromatics/100 g of molecular sieves per one adsorption cycle) to reduce the level of aromatics in the product stream to be below about 0.01% by weight.

Referring once again to the schematic drawing, a typical embodiment for practicing the liquid phase purification of the present invention comprises passing a liquid paraffin from vessel 12 through the type X molecular sieve bed 11 contained in adsorber 10 via line 18, pump 13, line 19, heat exchanger 14, and line 21. During the adsorption phase of the process, with valve 22 open and valves 23 and 24 closed, the aromatic hydrocarbons contained in the paraffin feed would be adsorbed in the pores of the type X molecular sieve bed 11 and the purified paraffin product would be recovered via line 26. The adsorption phase of the process thus would be carried out in the liquid phase and, with the aid of heat exchanger 14, at a temperature in the range of about 70°–90° C.

As the adsorption capacity of the molecular sieve bed diminishes because of the increased levels of adsorbed aromatic hydrocarbons, the valve 22 is closed to terminate the adsorption phase of the process. At this point, valve 24 is opened and a washing solvent such as n-heptane is pumped through the bed 11 via line 27, pump 13, line 19, heat exchanger 14 and line 21 unit all of the liquid paraffin product contained in the column 10 has been passed through line 26 to storage. As is the case with the adsorption phase, the washing phase desirably is accomplished at a temperature on the order of about 70°–90° C.

The valve 24 then is closed and the desorption phase is initiated by opening valve 23 and passing a desorbent, such as ethanol, through line 28, pump 13, line 19, heat exchanger 14 and line 21 into the molecular sieve bed. As the desorbent is being pumped into the bed 11, at least during the relatively early stages of the desorption phase, the washing solvent contained in the column 10 is displaced and removed through line 26. This washing solvent may be discarded, but from an ecomonic standpoint, it is more desirable to recover the washing solvent for future use. As the desorption phase continues, again in the liquid phase at a preferred temperature on the order of about 70°–90° C., the aromatic hydrocarbon contaminants are forced from the pores of the molecular sieve material. Once the desorption has been accomplished to the desired degree, the valve 23 is closed and the valve 24 is opened to initiate another washing phase. During this latter washing phase the desorbed aromatic hydrocarbons impurities are flushed from the column 10 and are passed together with the washing solvent via line 26 to waste, to storage or, if desired, to further processing.

The adsorptive capacity of the zeolite bed 11 having been restored, the process of purifying additional paraffins may be commenced once again by closing valve 24, opening valve 22 and proceeding as outlined above.

The following table summarizes the operating parameters for the process of the invention.

TABLE I

| | Typical Range | Preferred Range |
|---|---|---|
| Adsorption Phase (liquid Phase) | | |
| Temperature, °C. | 60–120 | 70–90 |
| Pressure, p.s.i.a. | 15–100 | 15–20 |
| Total Average Liquid Paraffin Feed Rate, c.c./min. | 0.5–50 | 0.5–10 |
| Removable Aromatic Hydrocarbons in Feed, % by wt. | 0.001–25 | 0.01–5 |
| Liquid Paraffin Feed | $C_5$–$C_{60}$ | $C_8$–$C_{24}$ |
| Duration of Phase, Min. | 60–240 | 90–180 |
| Desorbent in Feed | 0 | 0 |
| Desorption Phase (Liquid Phase) | | |
| Temperature, °C. | 60–120 | 70–90 |
| Pressure p.s.i.a. | 15–100 | 15–20 |
| Desorbent | $C_1$–$C_5$ Alcohol | $C_1$ or $C_2$ Alcohol |
| Total Average Desorbent Feed Rate, c.c./min. | 2–80 | 2–20 |
| Duration of Phase, Min. | 15–90 | 30–45 |
| Washing Phase (Liquid Phase) | | |
| Temperature, °C. | 60–120 | 70–90 |
| Pressure, p.s.i.a. | 15–100 | 15–20 |
| Washing Solvent | $C_5$–$C_7$ n-alkanes or iso-octane | n-heptane or iso-octane |
| Total Average Washing Solvent Feed Rate c.c./min. | 2–80 | 2–20 |
| Duration of Phase, Min. | 15–90 | 30–45 |

It will be appreciated by those skilled in the art that the temperature of the bed 11 of molecular sieve material may be maintained at the desired level by well-known methods. Thus, in addition to passing the liquid paraffin, washing solvent and/or desorbent through the heat exchanger 14, the bed 11 or column 10 containing the bed 11 may be heated or cooled as necessary by direct or indirect heat transfer. Similarly, during any of the adsorption, desorption or washing phases, the operating parameters, (e.g., feed rate, temperature, pressure etc.) may be varied to optimize or otherwise enhance the desired purification process.

The many advantages of the process are illustrated in the following examples.

EXAMPLE 1

A glass tube, 16 mm in diameter and 550 mm in height, was charged with a bed of 56 g. of NaX (13X) type zeolite which had been crushed into particules of 0.5–1 mm size. The zeolite material had been preactivated at 450°–500° C. for 4–5 hours and was used as an adsorbent for removing aromatic hydrocarbons from a crude liquid $C_8$–$C_{24}$ paraffin feedstock having an initial aromatic content of 3.22% by weight. A series of adsorption runs were carried out in the liquid phase and under dynamic conditions with the crude paraffin feedstock being preheated to the operating temperature indicated below. The feedstock was pumped upwardly through the zeolite absorbent bed. In each run the feedstock was pumped through the zeolite bed only once with no recycle.

The series of adsorption runs were made at temperatures ranging from 70°–120° C. and crude paraffin flow rates ranging from 0.5–10 c.c./min. Breakthrough was observed when the aromatic content in the purified paraffin had reached equilibrium. After each adsorption run the zeolite bed was washed with n-heptane, which was preheated to the stated temperature to remove any residual paraffin. The zeolite bed was then desorbed using a solvent to remove the aromatic hydrocarbons adsorbed from the crude liquid paraffin. The solvent was preheated to the stated operating temperature.

The dynamic properties of the adsorption runs were calculated to determine the efficiency of the zeolite properties, including the length of utilized bed height in mm, the dynamic capacity of g/100 g of zeolite, and the adsorption efficiency. Samples of the dearomatized liquid paraffin were collected and tested by UV spectroscopic techniques and each run was considered to be completed when the equilibrium point was reached. The results of the runs are set forth in Tables II and III:

TABLE II

| Run # | Oper. Temp. °C. | Paraffin Flow Rate c.c./min. | Dynamic Capacity g/100 g. | Length of Utilized Bed, mm | Adsorption Efficiency, % | Zeolite Fraction mm |
|---|---|---|---|---|---|---|
| 1 | 100 | 0.5 | 11.80 | 275.0 | 87.0 | 1–2 |
| 2 | 100 | 3.0 | 9.00 | 240.0 | 65.0 | 1–2 |
| 3 | 80 | 1.0 | 15.06 | 308.5 | 72.0 | 1–2 |
| 4 | 120 | 1.0 | 0* | 1041.5 | 5.3 | 1–2 |
| 5 | 80 | 1.0 | 21.77 | 67.3 | 94.0 | 0.5–1 |

*This value is "0" because high purity of liquid paraffin (0.01% weight aromatic content) cannot be achieved at these conditions.
i.e. longer adsorption column required.

TABLE III

| Run # | Aromatic Content of Purified Liquid Paraffin, % by Weight | Aromatic Content of Desorption Concentrate, % by Weight | Desorbing Solvent |
|---|---|---|---|
| 1 | 0.01 | 93.69 | ethanol |
| 2 | 0.01 | 85.60 | methanol |
| 3 | 0.01 | 72.40 | prapan-2-01 |
| 4 | 0.01 | 70.60 | Butan-1-01 |

The results of the adsorption runs indicate that the X-type molecular sieves have a high affinity for adsorbing aromatic hydrocarbons with a dynamic capacity as high as 23.4 g/100 g of molecular sieves. The results also indicate that as much as 441 ml of purified liquid paraffin having an aromatic content of 0.01% can be obtained using only one adsorption cycle, whereas in the corresponding desorption cycle, concentrates containing up to 93.69% by weight of aromatic hydrocarbons and sulfur compounds were produced.

EXAMPLE 2

The procedure of Example 1 was repeated except that a crude feedstock of partially dearomatized 220°–310° C. liquid paraffin obtained from a kerosene-diesel cut was used. The crude feedstock had the following characteristics:

TABLE IV

| | | |
|---|---|---|
| Refractive index, | $n_D^{20}$ | 1.4295 |
| Density, g/cm$^3$ | $p_4^{20}$ | 0.78 |
| Aromatic content, % by wt. | | 2.4 |
| Unsaturates content, % by wt. | | 0.1–0.2 |
| Sulfur, ppm | | less than 100 |

The results of this example are set forth in Tables V and VI.

TABLE V

| Run # | Oper. Temp. °C. | Paraffin Flow Rate cc/min | Dynamic Capacity g/100 g. | Length of Utilized Bed, mm | Adsorption Efficiency, % |
|---|---|---|---|---|---|
| 1 | 100 | 1.0 | 6.95 | 139 | 87.0 |
| 2 | 100 | 0.5 | 8.05 | 500 | 75.0 |
| 3 | 80 | 1.0 | 12.57 | 267 | 72.0 |
| 4 | 80 | 1.5 | 9.20 | 305 | 81.0 |

TABLE VI

| Run # | Aromatic Content of Purified Liquid Paraffin, % by Weight | Aromatic Content of Desorption Controls % by Weight | Desorbing Solvent |
|---|---|---|---|
| 1 | 0.01 | 92.0 | ethanol |
| 2 | 0.01 | 82.0 | methanol |
| 3 | 0.01 | 75.0 | prapan-2-01 |

The purified liquid paraffin materials obtained in accordance with the present invention contain less than about 0.01% by weight aromatic hydrocarbons (mono, di-, and tri-aromatic hydrocarbons) and are suitable for use in pharmaceutical and single cell protein production.

Although the foregoing describes certain preferred embodiments of the invention, it is contemplated that modifications thereof will be appreciated by those skilled in the art and that such modifications are within the spirit and scope of the invention as set forth herein.

What is claimed is:

1. A liquid phase process for separating aromatic hydrocarbon impurities from a liquid containing a $C_8$–$C_{24}$ liquid paraffin, which comprises:

contacting said liquid mixture in a single pass at a temperature in the range of about 60° C. to about 120° C. with a bed of at least partially dehydrated crystalline X-type zeolite adsorbent material, said zeolite material having pores sufficiently large to adsorb said aromatic hydrocarbon impurities;

discharging a purified aromatic hydrocarbon-depleted liquid paraffin from said bed, said purified liquid paraffin having an aromatic hydrocarbon content of less than about 0.01% by weight;

desorbing the adsorbed aromatic hydrocarbon impurities from said bed of adsorbent material by treating said bed with a liquid desorbing solvent in the liquid phase at a temperature of from about 60° C. to about 120° C.; and washing said bed with a liquid washing solvent to remove residual impurities therefrom, said washing being conducted at a temperature in the range of from about 60° C. to about 120° C.

2. The process of claim 1, wherein said X-type zeolite adsorbent material is selected from the group consisting of NaX zeolite and CaX zeolite.

3. The process of claim 2, wherein said contacting step is performed at a temperature of from about 70° C. to about 90° C.

4. The process of claim 3, wherein the liquid mixture from which the aromatic hydrocarbons are to be separated comprises a $C_8$–$C_{24}$ liquid paraffin isolated from a kerosene-diesel cut.

5. The process of claim 3, wherein the liquid mixture from which the aromatic hydrocarbons are to be separated comprises a $C_9$–$C_{22}$ liquid paraffin isolated from a kerosene-diesel cut.

6. The process of claim 3, wherein the liquid mixture from which the aromatic hydrocarbons are to be separated initially contains from about 0.01% to about 5% by weight aromatic hydrocarbons.

7. A liquid phase process for purifying a $C_8$–$C_{24}$ liquid paraffin feedstock, which feedstock contains an undesirably high concentration of aromatic hydrocarbon impurities, comprising the steps of:

adjusting the temperature of the liquid paraffin feedstock to about 60° C.–120° C.;

contacting the liquid paraffin feedstock at a temperature of from about 60° C. to about 120° C. with an X-type zeolite molecular sieve material for selectively adsorbing the aromatic impurities therefrom;

recovering an aromatic hydrocarbon-deleted liquid paraffin product, in the liquid phase, from said X-type zeolite molecular sieve material, said aromatic hydrocarbon-depleted liquid paraffin product containing less than about 0.01% by weight aromatic hydrocarbons;

desorbing the adsorbed aromatic hydrocarbons from said zeolite molecular sieve material by passing a liquid desorbing solvent therethrough at a temperature of from about 60° C. to about 120° C.; and washing the desorbed aromatic hydrocarbons from said zeolite molecular sieve material with a first liquid phase washing solvent.

8. The process of claim 7, wherein said liquid paraffin product is recovered by treating said X-type zeolite molecular material with a second liquid phase washing solvent at a temperature of from about 60° C. to about 120° C., said second washing solvent selectively removing said liquid paraffin from said X-type molecular sieve material while leaving the adsorbed aromatic impurities in place.

9. The process of claim 7, wherein said contacting step is performed at a temperature of from about 70° to about 90° C.

10. The process of claim 7, wherein said desorbing solvent is adjusted to a temperature of from about 70° to about 90° C.

11. The process of claim 8, wherein said first and second washing solvents are adjusted to a temperature of from about 70° C. to about 90° C.

12. The process of claim 7, wherein said desorbing solvent is a member selected from the group consisting of $C_1$–$C_5$ alcohols.

13. The process of claim 8, wherein each of said first and second washing solvents is a member selected from the group consisting of $C_5$–$C_7$ n-alkanes and iso-octane.

14. The process of claim 7, wherein said feedstock comprises partially dearomatized $C_9$–$C_{22}$ liquid paraffin feedstock.

15. The process of claim 7, wherein said feedstock comprises a partially dearomatized $C_8$–$C_{24}$ liquid paraffin feedstock.

16. The process of claim 7, wherein said feedstock comprises a partially dearomatized liquid paraffin obtained from a kerosene-diesel cut.

17. The process of claim 16, wherein said partially dearomatized liquid paraffin has an aromatic hydrocarbon content of from about 2% to about 4% by weight.

18. The process of claim 1, wherein said washing solvent is a member selected from the group consisting of $C_5$–$C_7$ n-alkanes and iso-octane.

19. The process of claim 1, wherein said desorbing solvent is a member selected from the group consisting of $C_1$–$C_5$ alcohols.

20. The process of claim 7, wherein said feedstock has an aromatic content of from about 0.01% to about 5% by weight.

* * * * *